US008395096B2

(12) United States Patent
Peck

(10) Patent No.: US 8,395,096 B2
(45) Date of Patent: Mar. 12, 2013

(54) PRECISION STRIP HEATING ELEMENT

(75) Inventor: Kevin B. Peck, Sonora, CA (US)

(73) Assignee: Sandvik Thermal Process, Inc., Sonora, CA (US)

( * ) Notice: Subject to any disclaimer, the term of this patent is extended or adjusted under 35 U.S.C. 154(b) by 457 days.

(21) Appl. No.: 12/697,719

(22) Filed: Feb. 1, 2010

(65) Prior Publication Data

US 2010/0193505 A1 Aug. 5, 2010

Related U.S. Application Data

(60) Provisional application No. 61/202,206, filed on Feb. 5, 2009.

(51) Int. Cl.
*H05B 3/10* (2006.01)

(52) U.S. Cl. ..... 219/548; 219/117.1; 219/119; 219/536; 219/538; 219/552; 219/553

(58) Field of Classification Search ..... 219/117.1, 219/119, 536, 538, 542, 548, 552, 553
See application file for complete search history.

(56) References Cited

U.S. PATENT DOCUMENTS

| | | | |
|---|---|---|---|
| 3,757,083 | A | 9/1973 | Dietz |
| 4,100,395 | A | 7/1978 | Ballard |
| 4,243,874 | A | 1/1981 | Fischer |
| 4,386,749 | A | 6/1983 | Sweet et al. |
| 4,596,922 | A | 6/1986 | Erickson |
| 5,038,019 | A | 8/1991 | McEntire et al. |
| 5,095,192 | A | 3/1992 | McEntire et al. |
| 5,157,241 | A | 10/1992 | Hehl |
| 5,323,484 | A | 6/1994 | Nakao et al. |
| 5,461,214 | A | 10/1995 | Peck et al. |
| 6,160,957 | A | 12/2000 | Johansson |
| 6,225,602 | B1 | 5/2001 | Buijze et al. |
| 6,471,780 | B1 | 10/2002 | Mercaldi et al. |
| 6,807,220 | B1 | 10/2004 | Peck |
| 7,027,722 | B2 | 4/2006 | Uemori et al. |
| 2007/0039938 | A1 | 2/2007 | Peck et al. |
| 2007/0257022 | A1 * | 11/2007 | Lin et al. ..... 219/443.1 |

FOREIGN PATENT DOCUMENTS

| | | |
|---|---|---|
| DE | 10 2007 003549 | 7/2008 |
| EP | 0 396 030 | 7/1990 |
| GB | 1 604 282 | 12/1981 |
| GB | 2 196 819 | 5/1988 |
| JP | 2-103885 | 4/1990 |
| JP | 3-62491 | 3/1991 |
| JP | 3-63494 | 3/1991 |
| JP | 3-63495 | 3/1991 |
| JP | 3-138886 | 6/1991 |
| JP | 5-57793 | * 7/1993 |
| JP | 10-273782 | 10/1998 |
| JP | 11-14269 | 1/1999 |
| JP | 2001-167862 | 6/2001 |
| JP | 2002-203662 | 7/2002 |

(Continued)

*Primary Examiner* — Meiya Li
(74) *Attorney, Agent, or Firm* — Morgan, Lewis & Bockius LLP

(57) ABSTRACT

A heating element includes a continuous planar strip and a plurality of mounting members. A path of the continuous strip from a first end to a second end is circuitous and includes a plurality of repeating cycles, each of which includes a plurality of first straight segments, a plurality of second straight segments and a plurality of radiused segments. A length of the first straight segment is greater than a length of the second straight segment and an angular sum of a single cycle of the circuitous path is greater than 360 degrees. The heating element can be incorporated into a heating assembly for, as an example, semiconductor processing equipment.

33 Claims, 17 Drawing Sheets

FOREIGN PATENT DOCUMENTS

| | | |
|---|---|---|
| JP | 2002-270529 | 9/2002 |
| JP | 2002-372381 | 12/2002 |
| JP | 2004-39967 | 2/2004 |
| JP | 2004 111332 | 4/2004 |
| JP | 2004-132587 | 4/2004 |
| JP | 2005-129273 | 5/2005 |
| JP | 2005-150101 | 6/2005 |
| JP | 2005-302593 | 10/2005 |
| JP | 2006-100755 | 4/2006 |
| JP | 2006-156119 | 6/2006 |
| JP | 2007-88324 | 4/2007 |
| WO | WO 2008/089951 | 7/2008 |

* cited by examiner

PRECISION STRIP HEATING ELEMENT

RELATED APPLICATION DATA

This application claims priority under 35 U.S.C. §119(e) to U.S. Provisional Application Ser. No. 61/202,206, filed Feb. 5, 2009, the entire contents of which are incorporated herein by reference.

FIELD

The present disclosure relates to heating elements. More particularly, the present disclosure relates to strip heating elements for furnaces, e.g., semiconductor processing furnaces, that have a circuitous path including straight and radiused segments that advantageously accommodates thermal expansion and contraction.

BACKGROUND

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

Conventional heating elements are generally formed of wire or sheet metal of various designs and geometries. However, wire patterned elements are generally limited in operating temperature by virtue of being embedded or semi-embedded in a surrounding medium, such as insulation. Further, wire patterned elements are typically not precision formed, are highly labor intensive and have a medium ratio of surface to mass resulting in fast heating and cooling. For sheet metal heating elements, those formed as primarily square patterns suffer from non-uniformity, while those with continuously curving patterns produce high stresses, both effects being more pronounced when the heating element expands at operating temperatures.

SUMMARY

A substantially uniformly radiating and substantially stress free heating element, even at operating temperatures, would be advantageous. Such a heating element can be included in a furnace to improve processing of items. For example such a heating element can be included in a semiconductor processing furnace for the processing of semiconductor wafers.

An exemplary heating element comprises a continuous planar strip, wherein a path of the continuous strip from a first end to a second end is circuitous and includes a plurality of repeating cycles, each repeating cycle including a plurality of first straight segments, a plurality of second straight segments and a plurality of radiused segments, wherein a length of the first straight segment is greater than a length of the second straight segment, and wherein an angular sum of a single cycle of the circuitous path is greater than 360 degrees.

An exemplary embodiment of a heating assembly comprises the heating element mounted in spaced relation to the insulating substrate by a plurality of mounting members.

An exemplary method of manufacturing a heating assembly comprises forming a heating element body from a resistance alloy, the heating element body including a continuous planar strip with an emitting surface and a plurality of mounting members, bending the plurality of mounting members out of plane relative to the continuous strip, and inserting the plurality of mounting members into a substrate until an integrated spacer on the mounting members contacts the substrate, wherein a path of the continuous strip from a first end to a second end is circuitous and includes a plurality of repeating cycles, each repeating cycle including a plurality of non-parallel first straight segments, a plurality of second straight segments and a plurality of radiused segments, wherein a length of the first straight segment is greater than a length of the second straight segment, and wherein an angular sum of a single cycle of the circuitous path is greater than 360 degrees.

Another exemplary method of manufacturing a heating assembly comprises forming a heating element body from a resistance alloy, the heating element body including a continuous planar strip with an emitting surface, and inserting a plurality of mounting members through an opening integrally formed on the continuous strip and into a substrate until a spacer associated with the mounting members contacts the substrate, wherein a path of the continuous strip from a first end to a second end is circuitous and includes a plurality of repeating cycles, each repeating cycle including a plurality of non-parallel first straight segments, a plurality of second straight segments and a plurality of radiused segments, wherein a length of the first straight segment is greater than a length of the second straight segment, and wherein an angular sum of a single cycle of the circuitous path is greater than 360 degrees.

It is to be understood that both the foregoing general description and the following detailed description are exemplary and explanatory and are intended to provide further explanation of the invention as claimed.

BRIEF DESCRIPTION OF THE DRAWING

The following detailed description can be read in connection with the accompanying drawings in which like numerals designate like elements and in which.

DETAILED DESCRIPTION

Figure 1:
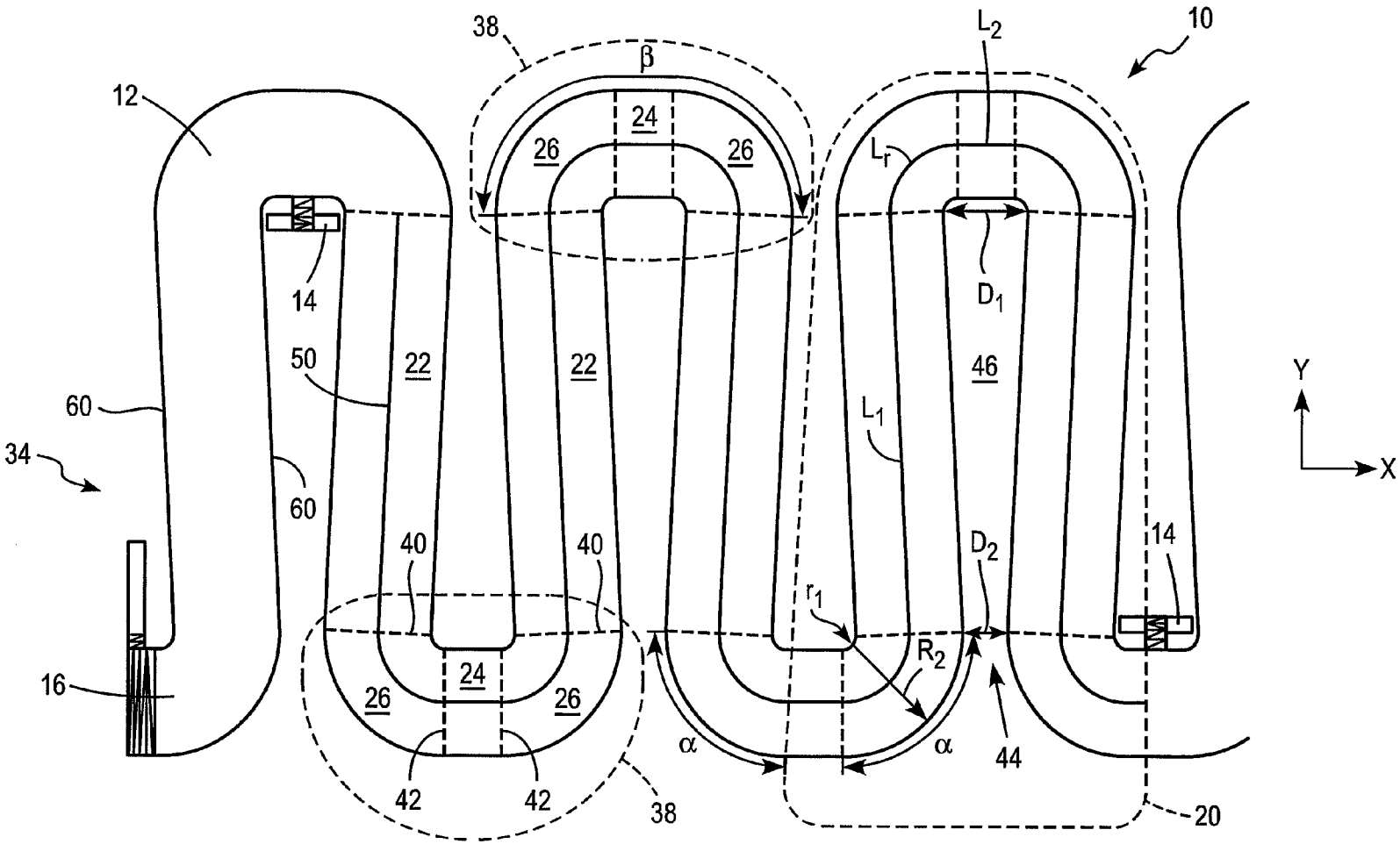
FIG. 1 is a plan, schematic view of an exemplary embodiment of a heating element.

An exemplary embodiment of a heating element 10 comprises a continuous planar strip 12 and a plurality of mounting members 14. A path of the continuous strip 12 from a first end 16 to a second end 18 is circuitous and includes a plurality of repeating cycles 20. Each repeating cycle 20 includes a plurality of non-parallel first straight segments 22, a plurality of second straight segments 24 and a plurality of radiused segments 26. An angular sum of a single cycle of the circuitous path is greater than 360 degrees.

The heating element 10 has an emitting surface 30 that generally extends in and generally is contained in a first plane. Within this first plane, the plurality of first straight segments 22 are oriented generally laterally to an axis 32 oriented from the first end 34 of the heating element 10 to a second end 36 of the heating element 10, e.g., within ±15 degrees of perpendicular to the axis 32. The plurality of second straight segments 24 are oriented generally longitudinally to the axis 32, e.g., within ±15 degrees of parallel to the axis 32. In an exemplary embodiment, any two consecutive first straight segments are generally (within ±15 degrees, alternatively within ±5 degrees) non-parallel and any two consecutive second straight segments are generally (within ±15 degrees, alternatively within ±5 degrees) parallel. Alternatively, any two consecutive first straight segments 22 are strictly non-parallel and/or any two consecutive any two consecutive second straight segments 24 are strictly parallel. The axis 32 is conventionally oriented in the X-axis direction.

In an exemplary embodiment, a single cycle 20 of the circuitous path includes two first straight segments 22, two second straight segments 24 and four radiused segments 26. The single cycle 20 includes two lobes 38. Each lobe 38 includes two radiused segments 26 and one second straight segment 24. The one second straight segment 24 separates the two radiused segments 26.

Figure 2:
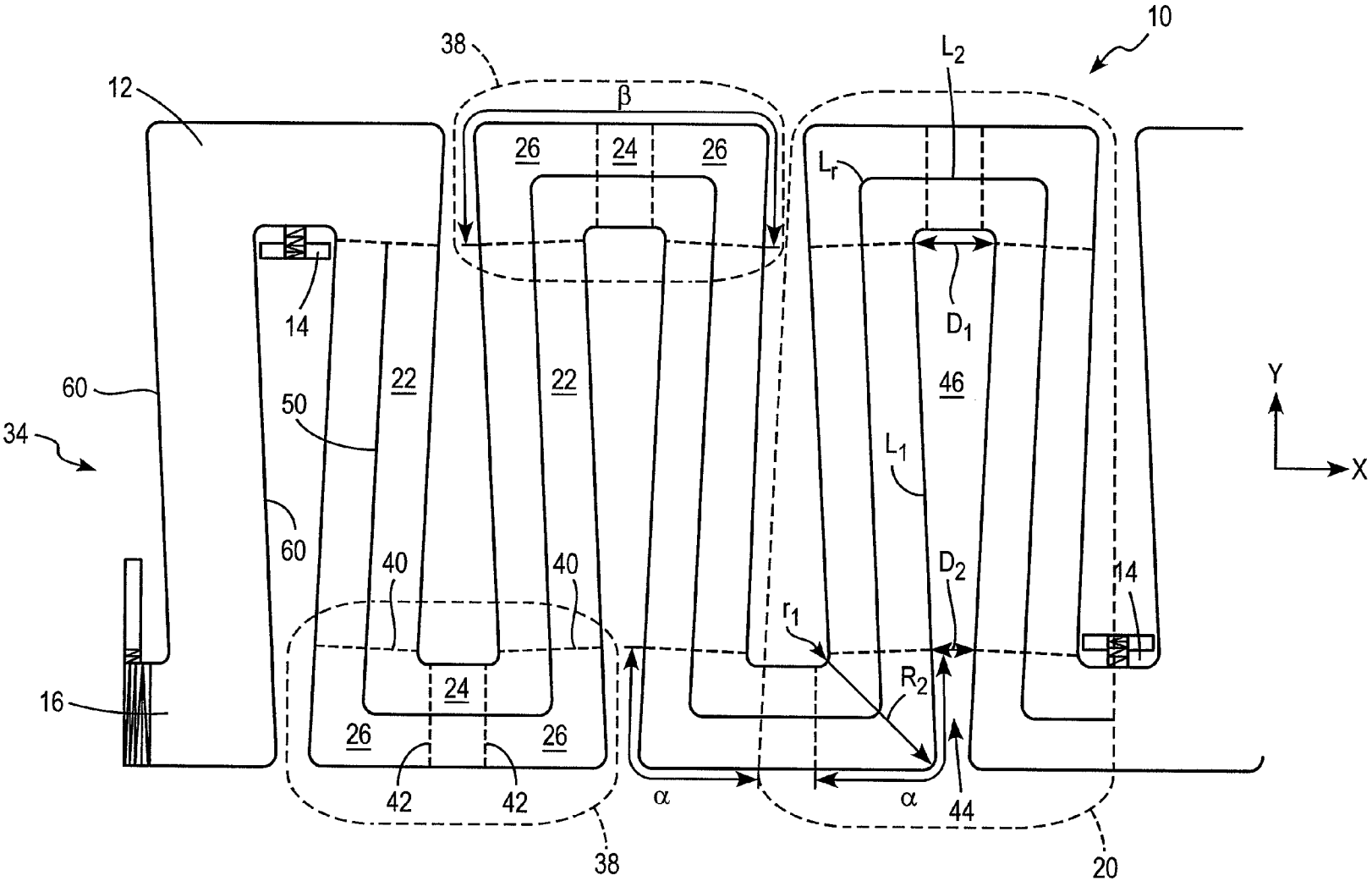
FIG. 2 is a plan, schematic view of a further exemplary embodiment of a heating element.

The radiused segment can take any suitable form. FIG. 1 is a plan, schematic view of an exemplary embodiment of a heating element 10. The cycles 20 in the exemplary embodiment shown in FIG. 1 have radiused segments 26 that are continuously radiused from the interface 40 of the radiused segment 26 with a first straight segment 22 to the interface 42 of the radiused segment 26 with a second straight segment 24. In this form, the cycle 20 is pseudo-sinusoidal relative to the axis 32, with both a positive portion (positive y-direction with respect to the axis 32 at the centerline) and a negative portion (negative y-direction with respect to the axis 32 at the centerline). FIG. 2 is a plan, schematic view of another exemplary embodiment of a heating element 10. The cycles 20 in the exemplary embodiment shown in FIG. 2 have radiused segments 26 that include both straight portions and continuously radiused portions from the interface 40 of the radiused segment 26 with a first straight segment 22 to the interface 40 of the radiused segment 26 with a second straight segment 24. In this form, the cycle 20 is pseudo-square relative to the axis 32, with the change in path direction in the lobes 38 approaching a squared-off geometry, with both a positive portion and a negative portion.

The radiused segments 26 in both the pseudo-sinusoidal and the pseudo-square form of the heating element 10 have both an interior radius $r_1$ and an exterior radius $R_2$. Each radiused segment 26 has an associated angle $\alpha$ that represents the angular change in direction of the circuitous path over the length $L_r$ of the radiused segment 26. With regard to individual radiused segments 24, exemplary embodiments of the radiused segments have an angle $\alpha$ that is between 90 degrees and 135 degrees, i.e., $90° < \alpha < 135°$, alternatively between 90 degrees and 100 degrees, i.e., $90° < \alpha < 100°$, In exemplary embodiments, an angular sum $\beta$ of the angles $\alpha$ of one lobe 38 is greater than 180 degrees, preferably greater than 180 degrees to about 200 degrees, more preferably about 185 to about 190 degrees. For example, the angular sump of a lobe 38 can be expressed as:

$$\beta = \Sigma \alpha_n$$

where n=number of radiused segments in the lobe. As each cycle includes two lobes, an angular sum of the angles $\alpha$ associated with a single cycle of the circuitous path is greater than 360 degrees, preferably greater than 360 degrees to about 400 degrees, more preferably about 370 to about 380 degrees.

The angular sum $\beta$ greater than 180 degrees results in the two first straight segments 22 adjacent the lobe 38 being non-parallel. This non-parallel relationship can be seen in both FIGS. 1 and 2. Towards the inner surface of the lobe 38, the two first straight segments 22 adjacent the lobe 38 are separated by a distance $D_1$ that is greater than a distance $D_2$ separating the same two first straight segments 22 near the mouth 44 of the opening 46 between lobes 38 in consecutive positive or negative portions. $D_1$ is measured at one end of the first straight segments 22 and $D_2$ is measured at a second end of the first straight segments 22.

The circuitous path of the heating element 10 can be idealized as a line 50 located at a centerline of the planar heating element 10. FIGS. 1 and 2 illustrate the location of the line 50 in the illustrated embodiments. This line 50 can be used to measure the distance of the circuitous path as well as to measure the angles $\alpha$ of the radiused segments 26 and the lengths $L_1$ of first straight segments 22, the lengths $L_2$ of the second straight segments 24 and the lengths $L_r$ of the radiused segments 26. A length $L_1$ of the first straight segment 22 is greater than a length $L_2$ of the second straight segment 24.

It can be understood by one skilled in the arts that the uniformity of power dissipation of an emitter is higher for a homogenous conductor of uniform cross-section and surface area. It is therefore desirable to maximize the ratio of the length of straight segments to the length of curved segments. It has been determined empirically that the following relationship yields a result with high uniformity, high fill-factor (ratio of substrate surface power to emitter surface power) and minimizes stress in the emitter. Furthermore, this relationship accommodates and controls expansion during transient conditions and over the useful life of the heating element.

In exemplary embodiments, the lengths of the first straight segments 22, the second straight segments 24 and radiused segments 26 in a single cycle are such that they satisfy the following relationship:

$$\frac{(L_{1,A} + L_{1,B} + L_{2,A} + L_{2,B})}{(L_{r,a} + L_{r,b})} > 2.0$$

where $L_{1,A}$ is the length $L_1$ of a first first straight segment 22, $L_{1,B}$ is the length $L_1$ of a second first straight segment 22, $L_{2,A}$ is the length $L_2$ of a first second straight segment 24, $L_{2,B}$ is the length $L_2$ of a second second straight segment 24, $L_{r,a}$ is the length $L_r$ of a first radiused segment 26 and $L_{r,b}$ is the length $L_r$ of a second radiused segment 26. Alternatively, the relationship above is greater than 2.2, further from greater than 2.2. to less than 10.0 or less than 5.0. This relationship represents the ratio of the length of straight segments to the length of radiused segments. For a uniform width of the emitter surface, this is also the ratio of surface areas of straight segments to radiused segments. An example of a suitable width is 8 mm. The length is measured at the center of the emitter path, i.e., along line 50.

FIGS. 3A-B and 4A-B schematically illustrate from two different perspectives, disassembled views of two exemplary embodiments of a heating assembly. The heating assembly 100 includes a heating element 10 and insulation 102. The insulation 102 can be any suitable insulation. In an exemplary embodiment, the insulation 102 includes an insulating substrate 104 with an alumina surface layer 106. Other suitable insulation 102 includes a substrate formed from an insulating material, preferably a ceramic fiber composite, with an alumina facing layer and a blended ceramic fiber backing layer. The heating element 10 can be any suitable heating element substantially consistent with the heating element 10 disclosed and described herein, e.g., as in any one of FIGS. 1 and 2. As shown in FIGS. 3A-B, 4A-B and 8 the heating element is pseudo-sinusoidal as in FIG. 1.

The heating element 10 includes a plurality of mounting members 14. The mounting members 14 extend from the periphery 60 of the continuous strip 12 at a plurality of locations along the circuitous path. The mounting members can be located at any suitable position. In one embodiment and as shown in FIGS. 1-4, the mounting members 14 are on an inner edge of the path proximate a maximum lateral position of the path, i.e., at or near the maximum position of positive and/or negative portions of the lobes 38. Alternatively, the mounting members 14 are on an outer edge of the path proximate a maximum lateral position of the path, i.e., at or near the maximum position of positive and/or negative portions of the lobes 38. In a further alternative, the mounting members 14 are on alternating peripheral edges of the continuous strip, preferably proximate a maximum lateral position of the path, i.e., at or near the maximum position of positive and/or negative portions of the lobes 38.

As shown in FIGS. 3A-B and FIGS. 5A-C, the plurality of mounting members 14 can be integrally formed with the continuous strip 12 and extend from the periphery 60 of the continuous strip 12 in substantially a second plane.

Figure 5A:
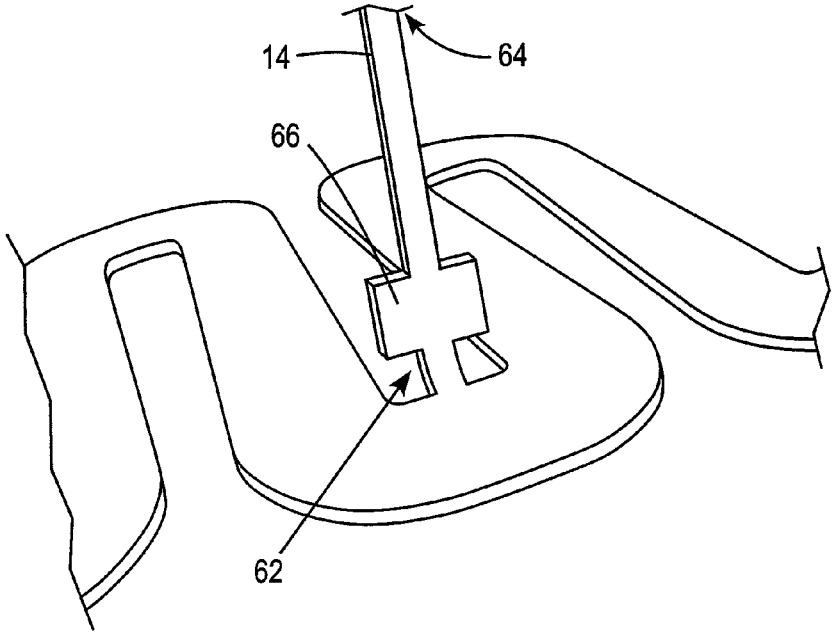
FIGS. 5A to 5C show portions of an exemplary embodiment of a heating element, including a first embodiment of a mounting member.
Figure 5B:
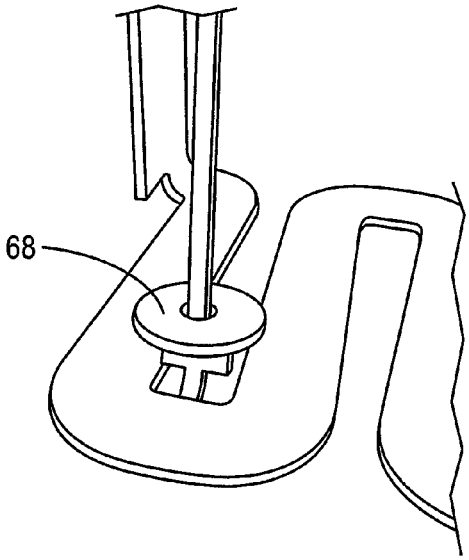
Figure 5C:
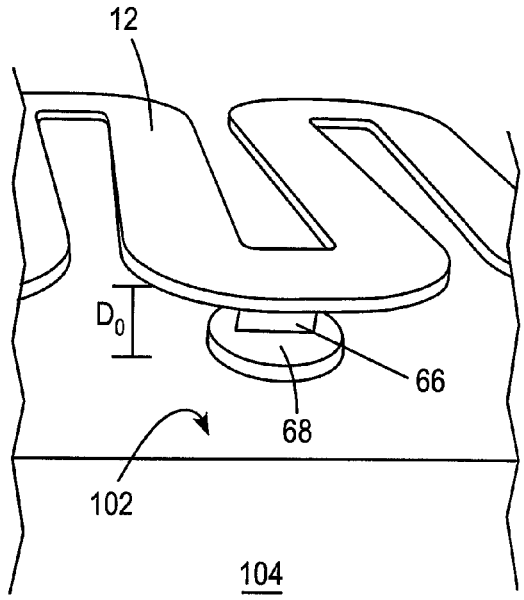

In a first embodiment, the mounting members 14 include a base end 62 and a distal end 64 and have an integrated spacer 66 at the base end 62. A length the integrated spacer 66 extends from the base end 62 defines a stand-off distance for the continuous strip 12 when the heating element 10 is mounted to a substrate 102. A washer 68 or other plane surface can be optionally included to prevent the integrated spacer 66 from embedding into the insulation 102. FIG. 5A shows the integrally formed mounting member 14 extending approximately 90 degrees out of plane from the continuous strip 12. In FIG. 5B, a washer 68 has been placed on the mounting member 14, which functions to prevent the integrated spacer 66 from embedding into the insulation 102. FIG. 5C shows a portion of a fully assembled heating assembly 100 with the distal end 64 penetrating the insulation 102 until the spacer 66 and the washer 68 contact a surface of the insulation 102 to form the stand-off distance $D_O$. Integrated mounting means are advantageously installed in shapes that are substantially flat with respect to the lateral dimension of the pattern.

Figure 4A:
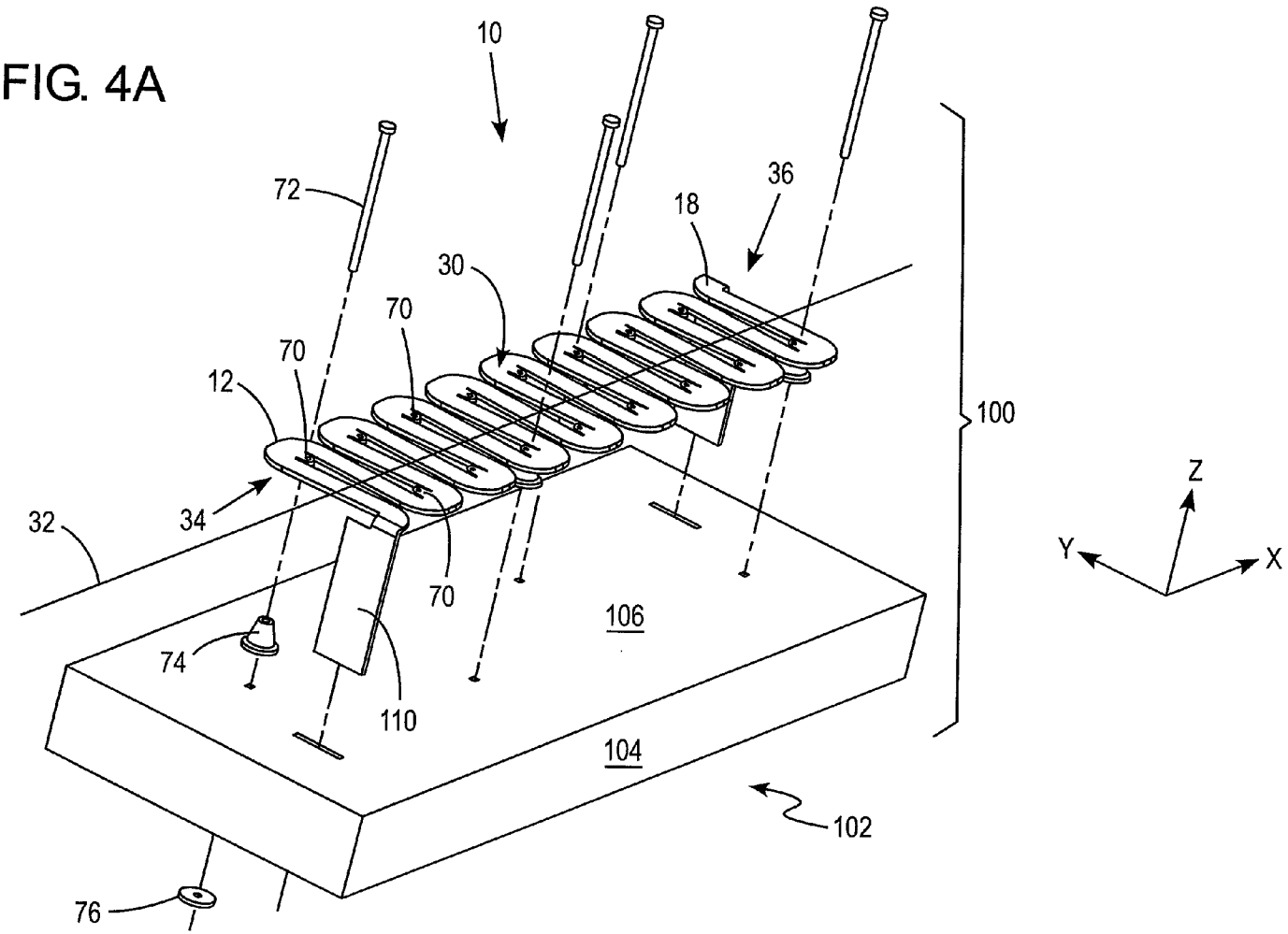
FIGS. 4A and 4B show two different perspective, disassembled views of another exemplary embodiment of a heating assembly.
Figure 4B:
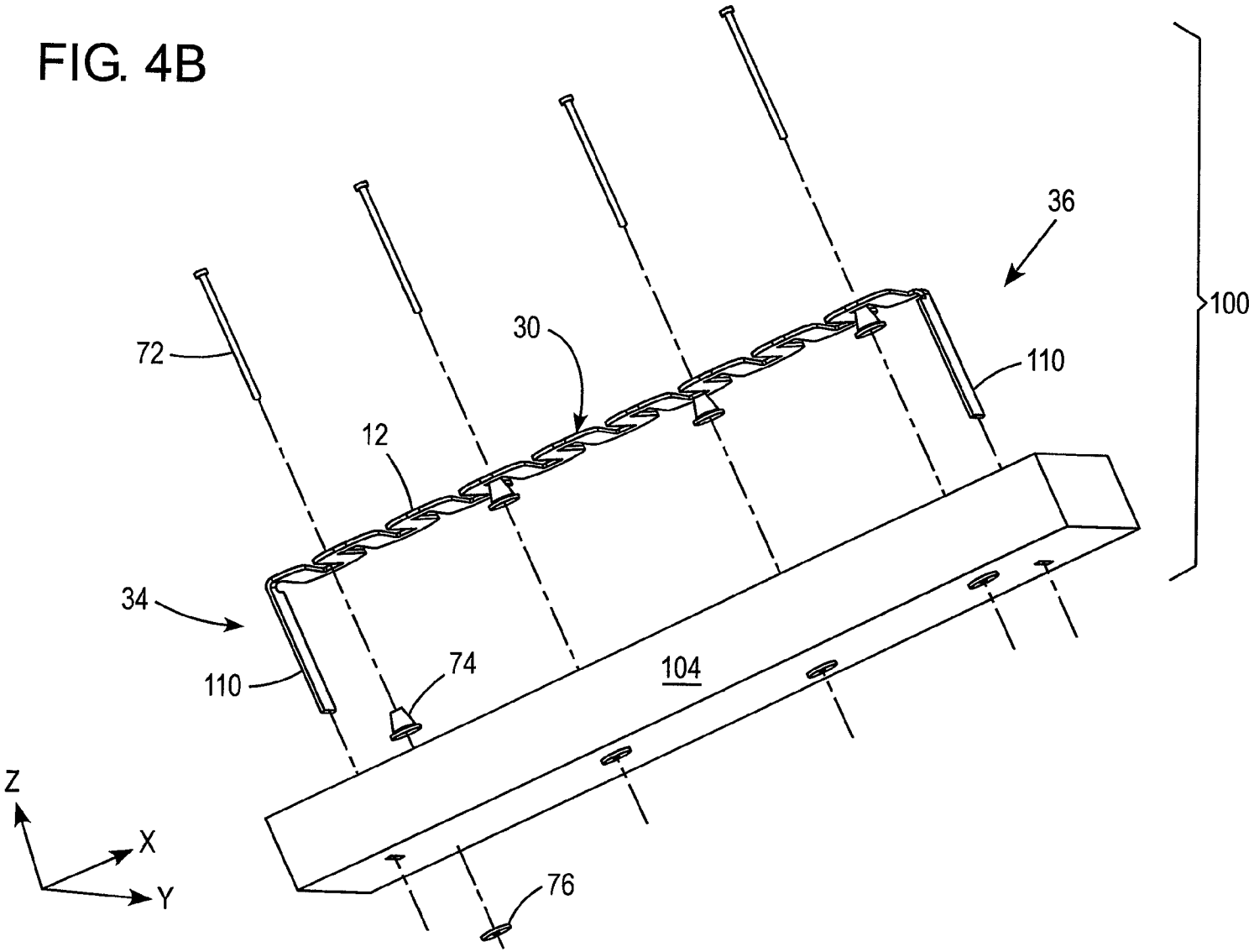
Figure 6:
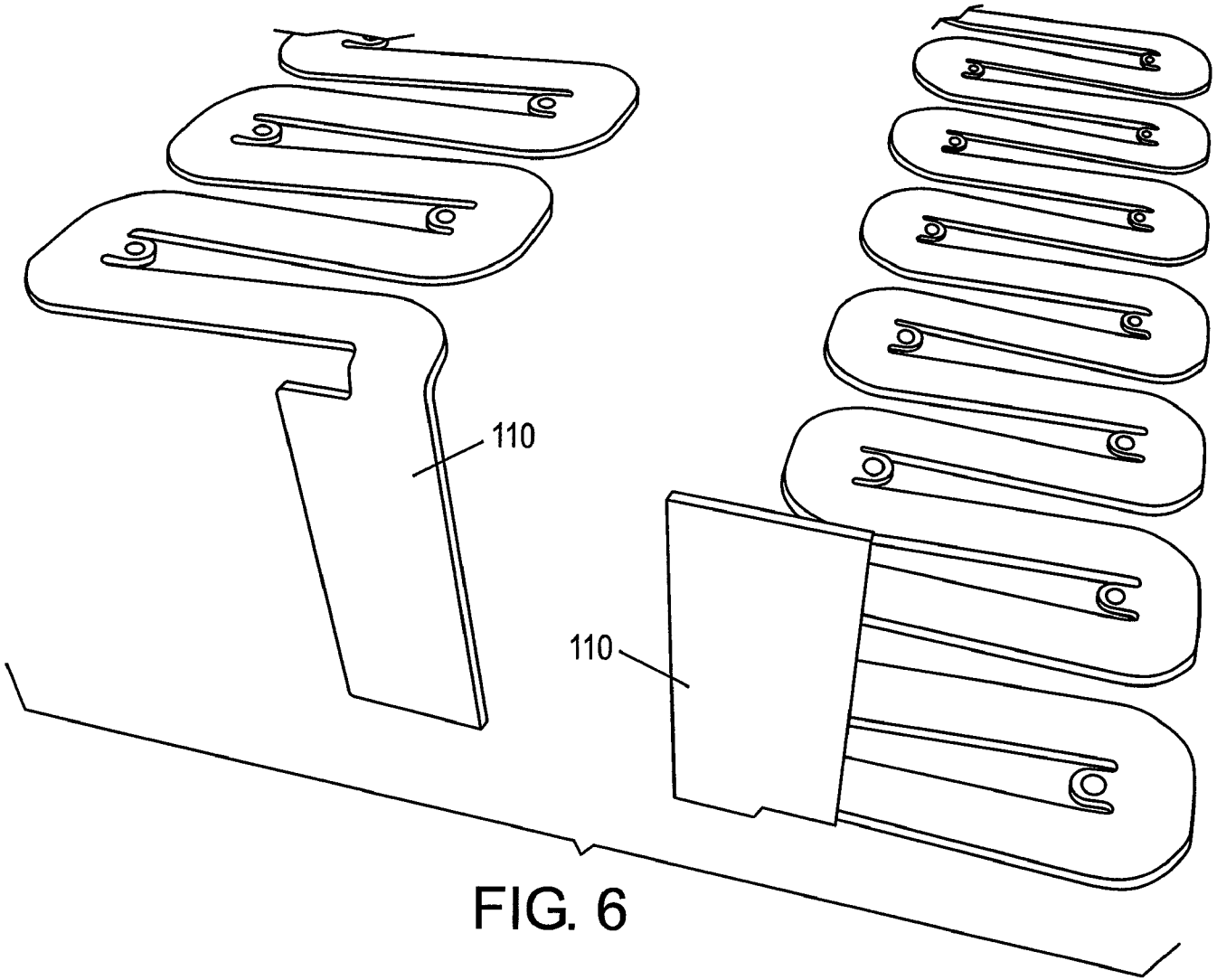
FIG. 6 shows portions of another exemplary embodiment of a heating element, including a second embodiment of a mounting member.
Figures 7A, 7B, 7C, 7D:
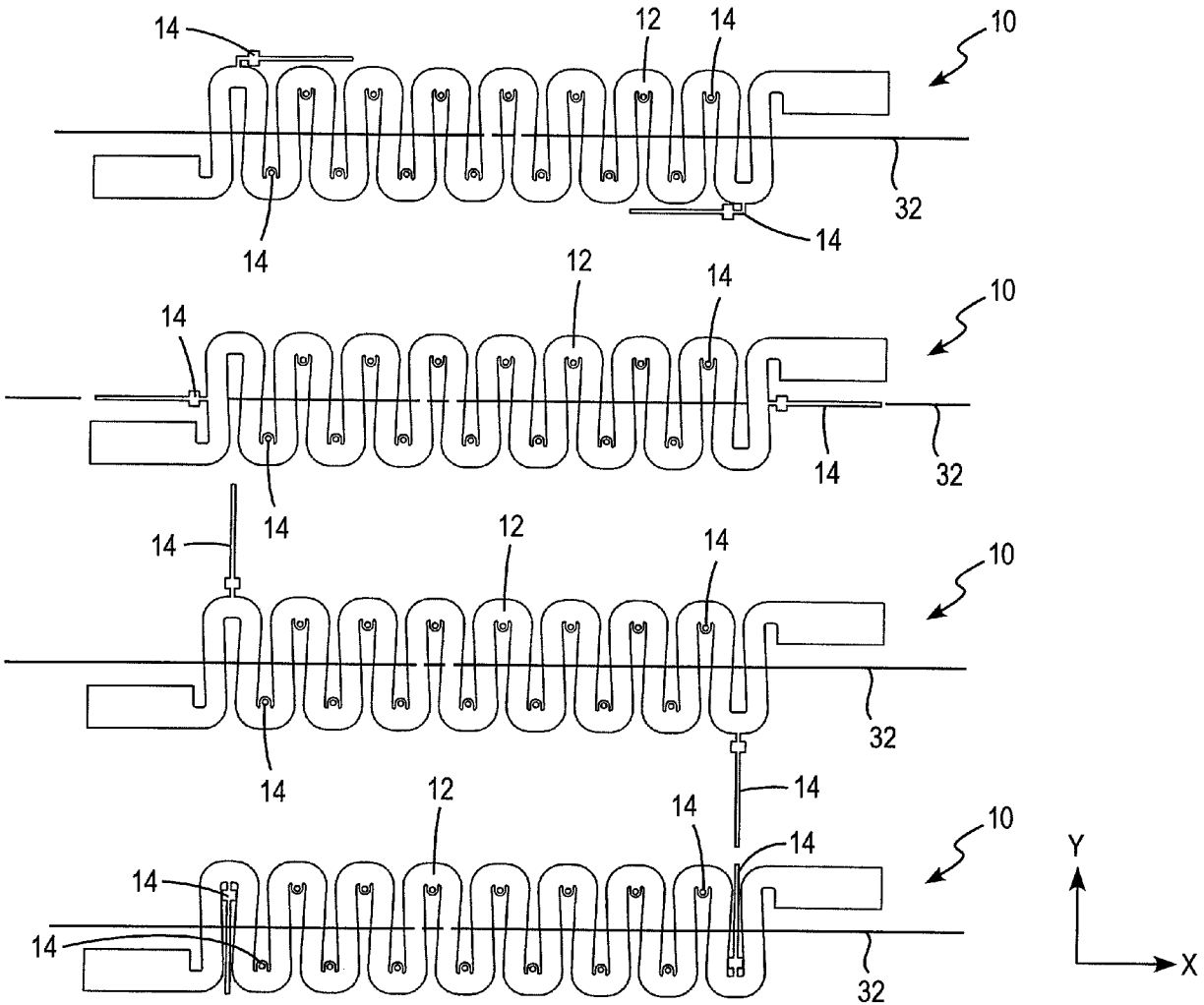
FIGS. 7A-D show, in plan view, several embodiments of a heating element with a combination of types of integrated mounting members and mounting members that are separate elements.

As shown in FIGS. 4A-B and FIG. 6, the plurality of mounting members 14 can be separate elements, including an opening 70 integrally formed on the continuous strip 12 and an extension assembly including a pin 72 and a spacer 74. To mount the continuous strip 12 to the insulation 102, the pin 72 is operably positioned in the opening 70 to extend in substantially a second plane. The pin 72 also anchors a spacer 74 in position, which provides a stand-off distance between the heating element 10 and the insulation 102. Another washer 76 can optionally be on an opposite side of the insulation 102 to provide support and/or anchoring. When the mounting members 14 are separate elements, the mounting members 14 can incorporate ceramic, metallic and/or composite structures. Another example of a suitable spacer is a length of tubing equal to the desired stand-off distance between the heating element and the substrate. Mounting members with separate elements are advantageously installed in shapes that are substantially curved with respect to the lateral dimension of the pattern.

As used herein, the second plane is different from the first plane in which the emitting surface 30 generally extends and generally is contained. As an example, the first plane is oriented substantially consistent with an XY-plane and the second plane is substantially consistent with a YZ-plane or a XZ-plane of a right-handed, three-dimensional Cartesian coordinate system.

In a further exemplary embodiment, a combination of the integrated mounting members, such as mounting members 14 shown in FIG. 1, and mounting members that are separate elements, such as mounting members 14 shown in FIGS. 4A-B, can be used on the same heating element 10. In such a case, the integrated mounting members could be used to hold the heating element in place, while the mounting members that are separate elements could be added once the heating element is installed to the insulation. A combination of integrated mounting members and mounting members that are separate elements could be advantageous for non-flat installations.

FIGS. 7A-D show, in plan view, several embodiments of a heating element 10 with a combination of types of integrated mounting members and mounting members that are separate elements. FIGS. 7A-D illustrate the mounting members prior to any bending of such members for installation. FIGS. 7A-D show variations in the location of the integrated mounting members. Thus, in FIG. 7A, the integrated mounting members 14 projects from an outer peripheral edge of the lobe; in FIG. 7B, the integrated mounting members 14 projects from an outer peripheral edge of the first straight segment; in FIG. 7C, the integrated mounting members 14 projects from an outer peripheral edge of the second straight segment; and in FIG. 7D, the integrated mounting members 14 projects from an inner peripheral edge of the second straight segment. FIGS. 7A-D also show variations in the orientation of the integrated mounting members. Thus, in FIGS. 7A and 7B, the integrated mounting members 14 are oriented substantially parallel with the axis 32 of the heating element and in FIGS. 7C and 7D, the integrated mounting members 14 are oriented substantially perpendicular to the axis 32 of the heating element.

Figure 8:
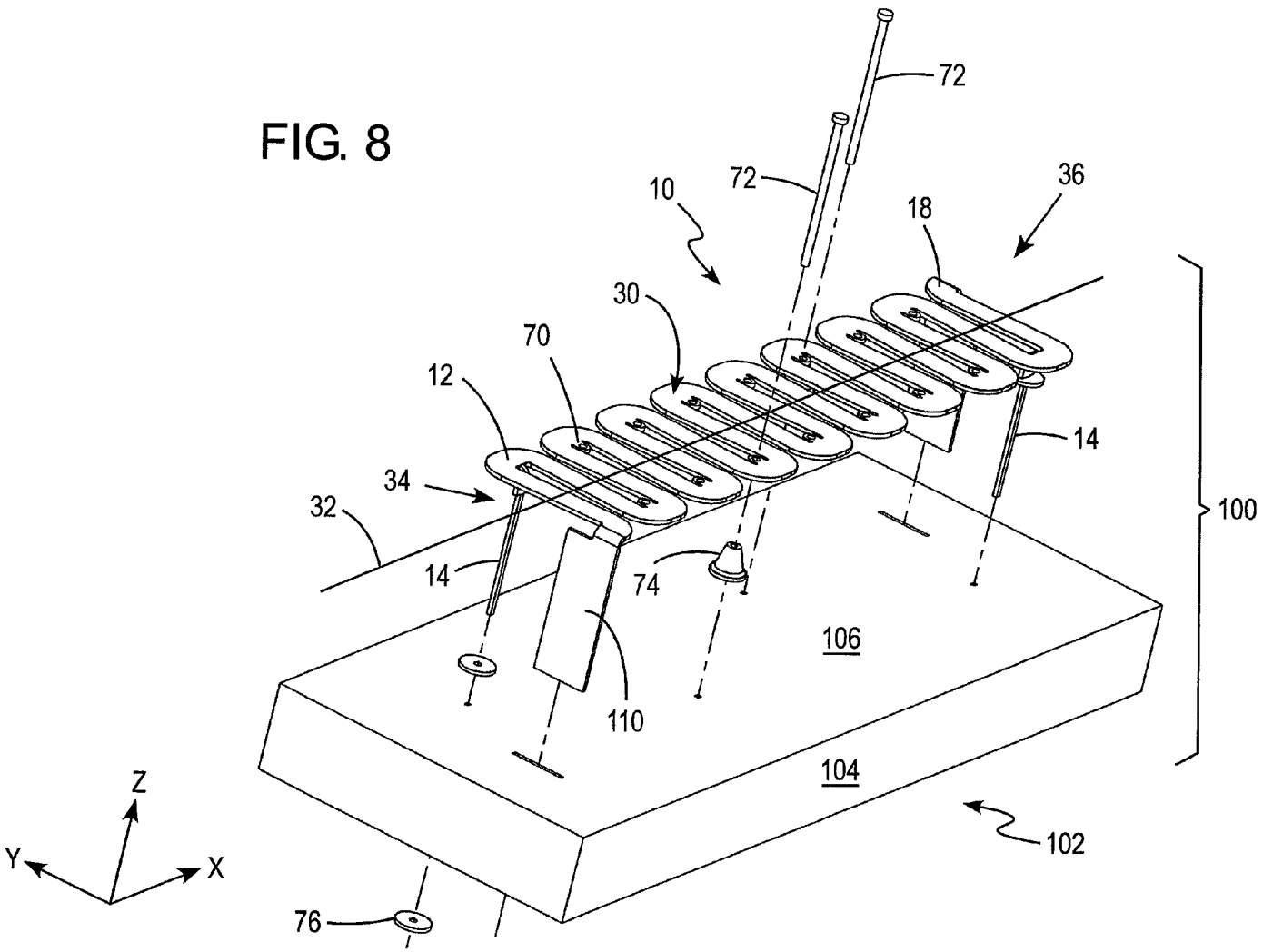
FIG. 8 shows a perspective, disassembled view of an exemplary embodiment of a heating assembly with a combination of types of integrated mounting members and mounting members that are separate elements.

FIG. 8 shows a perspective, disassembled view of another exemplary embodiment of a heating assembly 100 with a combination of types of integrated mounting members and mounting members that are separate elements, such as, for example, shown and described in one of the heating elements 10 in FIGS. 7A-D.

Figure 3A:
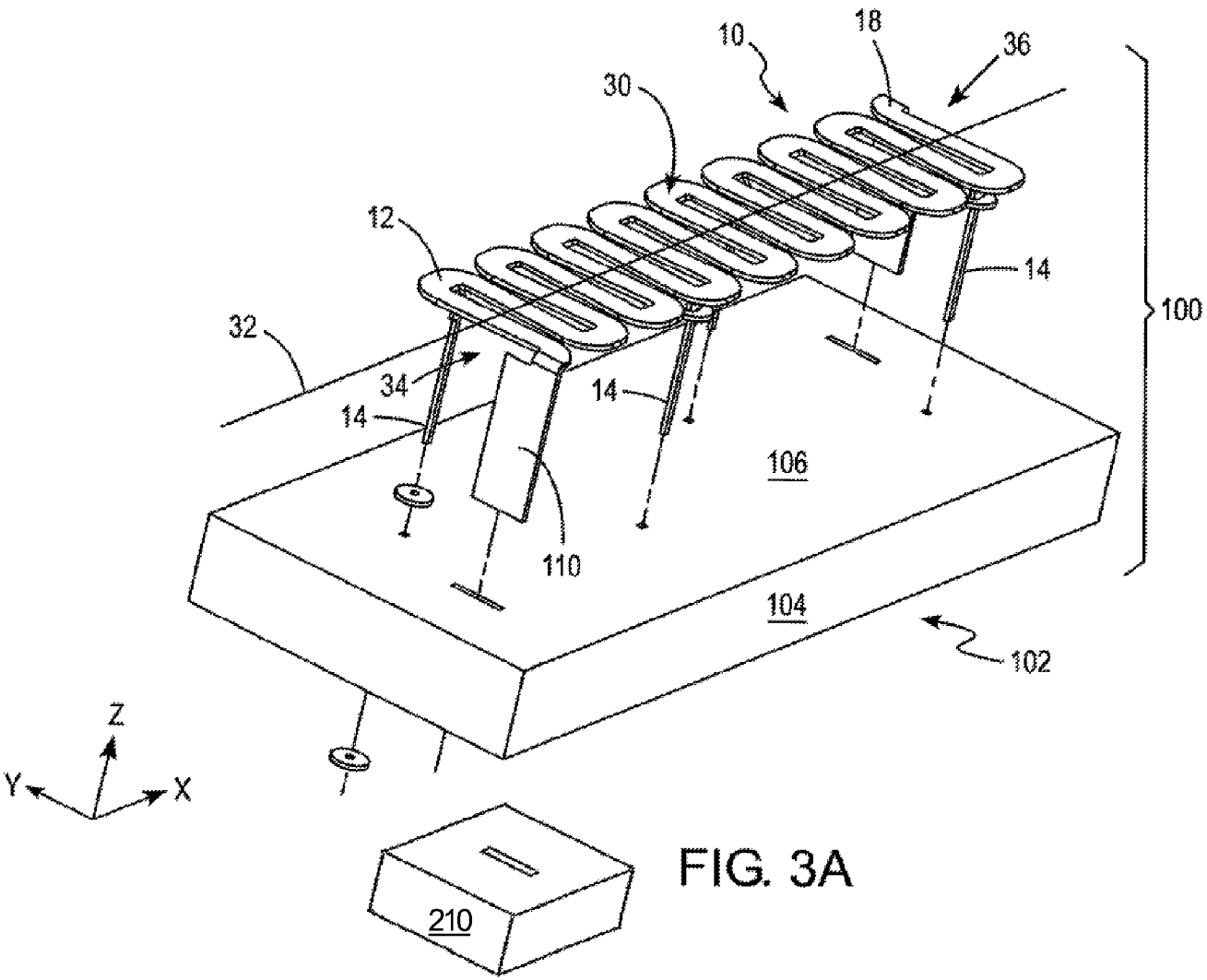
FIGS. 3A and 3B show two different perspective, disassembled views of an exemplary embodiment of a heating assembly.
Figure 3B:
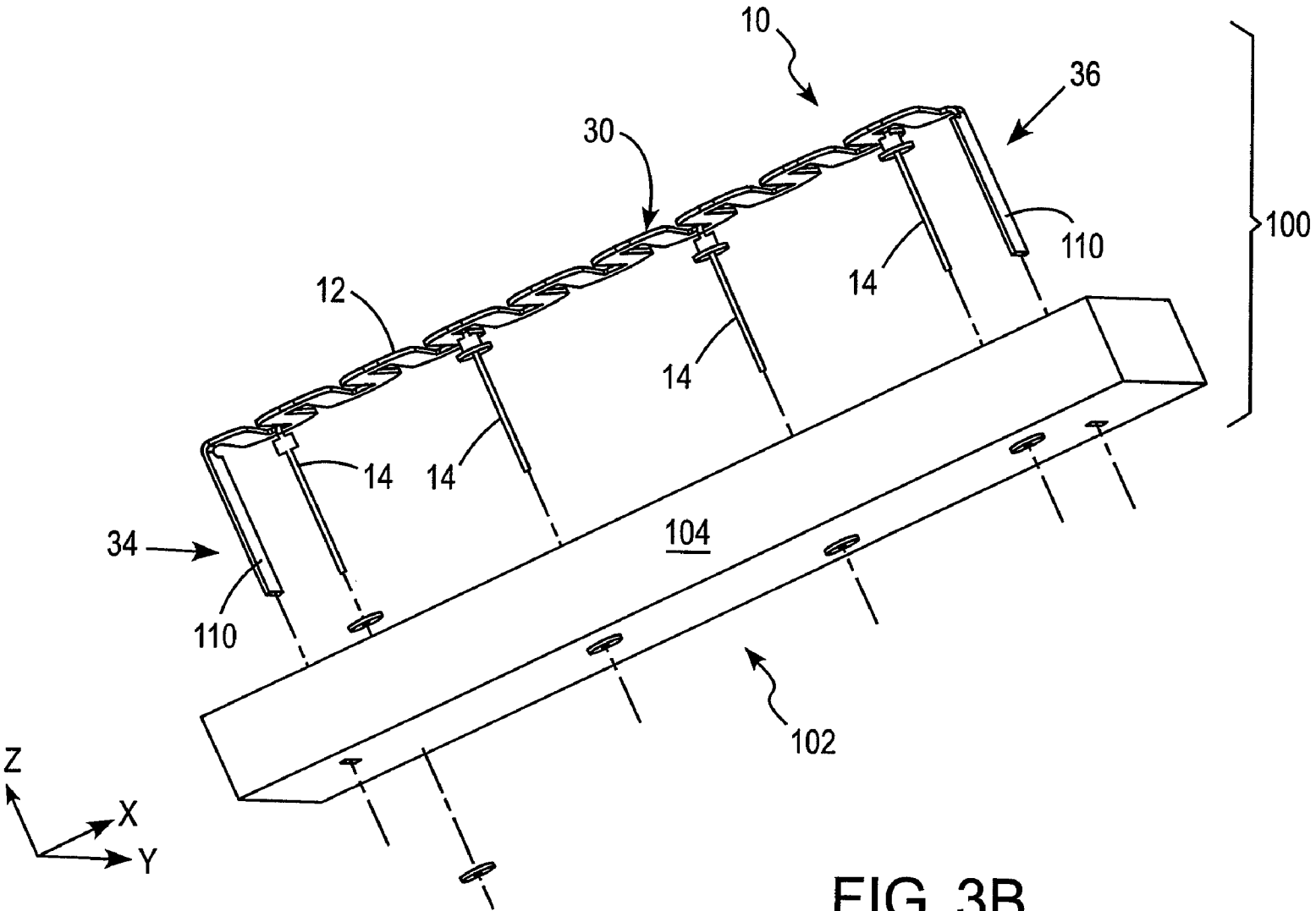

The heating element 10 comprises a power terminal 110 at the first end 34 or the second end 36 of the heating element 10. In alternative embodiments, the power terminals are located at locations other than the first end or second end. The power terminal connects to an electrical circuit of, for example, a semiconductor processing furnace. FIGS. 3, 4 and 6, for example, show examples of a suitable power terminal 110 and FIG. 3A shows an example of a power source 210. The heating element is heated by inducing an electrical current through it. In the disclosed embodiment, the electrical current is induced from a direct-coupled ac power source, but other methods and power sources could be employed such as direct coupled DC and inductively coupled power sources.

The heating element 10 can be formed from any suitable material. For example, in an exemplary embodiment, the heating element 10 is formed from a resistance alloy, preferably an iron chromium aluminum alloy. Other suitable resistance alloys include nickel chromium or ceramic alloys, such as molybdenum disilicide or silicon carbide. The resistance alloy can be formed into a heating element body by, for example, cutting the heating element body from a sheet of material, casting a heating element body, machining a heating element body, extruding, pressing, punching or canning a heating element body, or combinations of such methods.

Figure 9A:
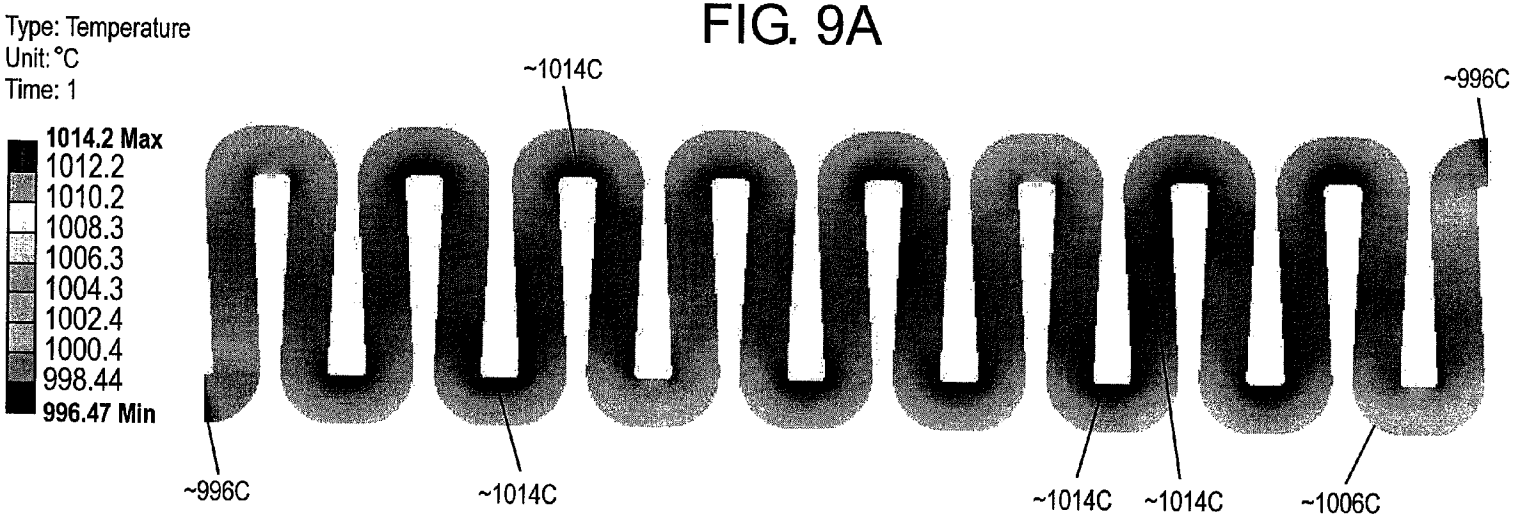
FIGS. 9A and 9B illustrates the modeled temperature distribution for the exemplary embodiment of a heating element as generally shown in FIG. 1 with a first embodiment of a mounting member (FIG. 9A) and with a second embodiment of a mounting member (FIG. 9B).
Figure 9B:
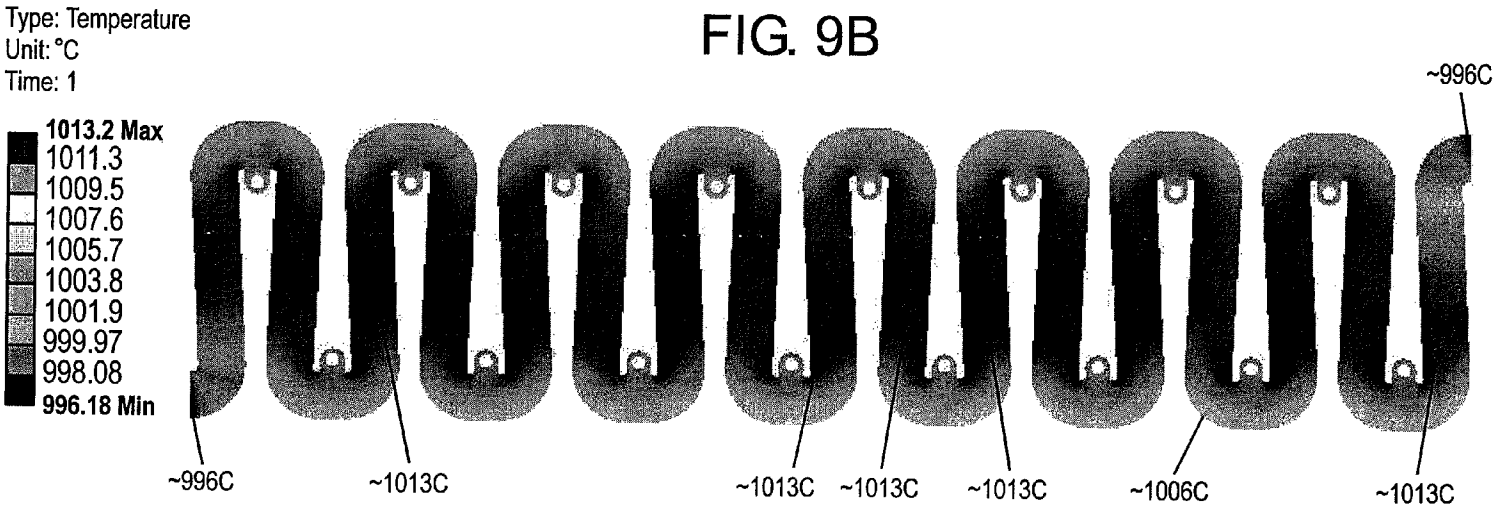
Figure 10:
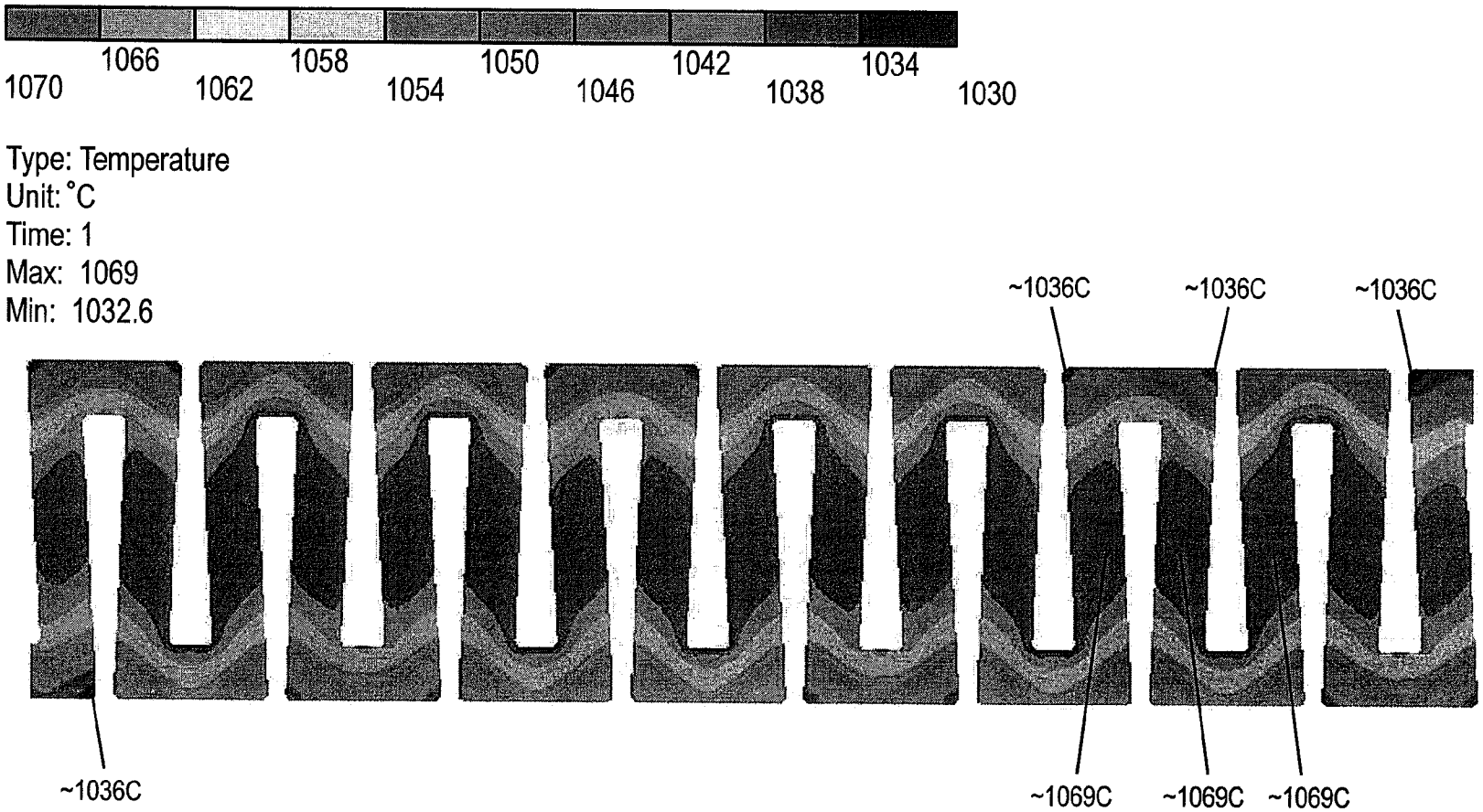
FIG. 10 illustrates the modeled temperature distribution for the exemplary embodiments of a heating element as generally shown in FIG. 2.
Figure 11:
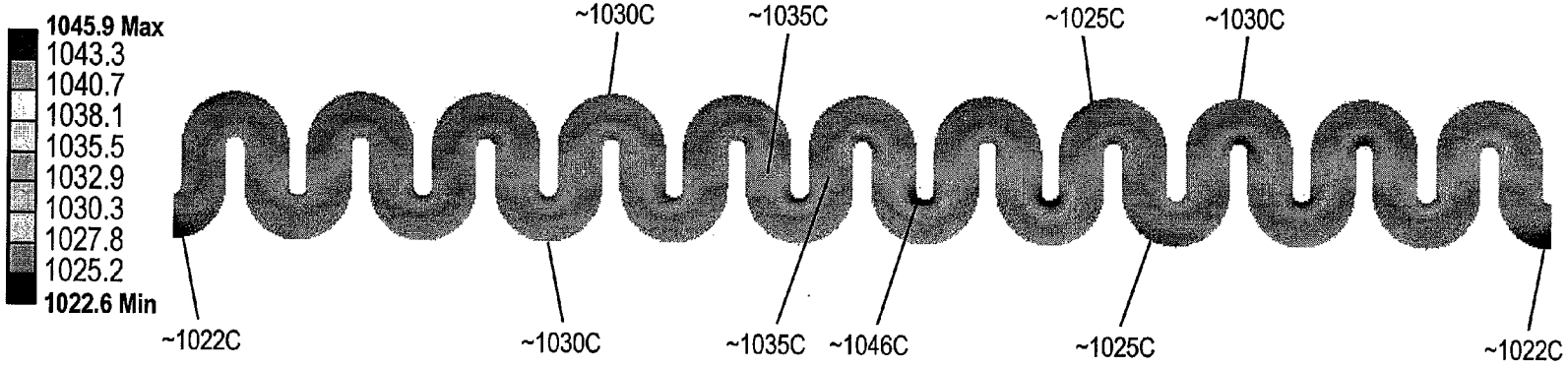
FIG. 11 (PRIOR ART)
FIG. 11 illustrates the modeled temperature distribution for a prior art heating element.

Embodiments of the disclosed heating element and heating assembly provide several advantages, either singly or in combination. For example, the pseudo-sinusoidal and pseudo-square patterns comprise a substantial portion of straight segments with substantially uniform width yielding highly uniform surface temperatures. FIGS. 9A-B and 10 show the temperature profile for both pseudo-sinusoidal patterns (FIGS. 9A and 9B) and pseudo-square patterns (FIG. 10). Note the different mounting members between the embodiment of FIG. 9A and the embodiment of FIG. 9B. For comparison, a temperature profile for a conventional design consisting primarily of curved segments is shown in FIG. 11. All of the temperature profiles are from a temperature profile model using the following parameters: current of 100 A and a furnace temperature of 1000° C.

In the pseudo-sinusoidal pattern, the difference between the highest and the lowest temperature ($\Delta T$) along the emitting surface is about 8° C. (FIG. 9A) and about 7° C. (FIG. 9B). The temperature variation can be represented as $\Delta T/T_{max}$ and is 0.79% for FIG. 9A and 0.69% for FIG. 9B. Values for the same parameters for the pseudo-square pattern in FIG. 10 are $\Delta T$ of about 33° C. and $\Delta T/T_{max}$ of 3.09%. In contrast, the values for these parameters for a conventional design consisting primarily of curved segments (FIG. 11) are $\Delta T$ of about 21° C. and $\Delta T/T_{max}$ of 2%. As seen from these figures, the temperature is most uniform for the pseudo-sinusoidal pattern (FIGS. 9A-B). While the temperature uniformity of the pseudo-square pattern (FIG. 10) is less uniform than for the conventional design consisting primarily of curved segments (FIG. 11), it still has an advantage over the conventional design because it better accommodates thermal expansion.

Figure 12A:
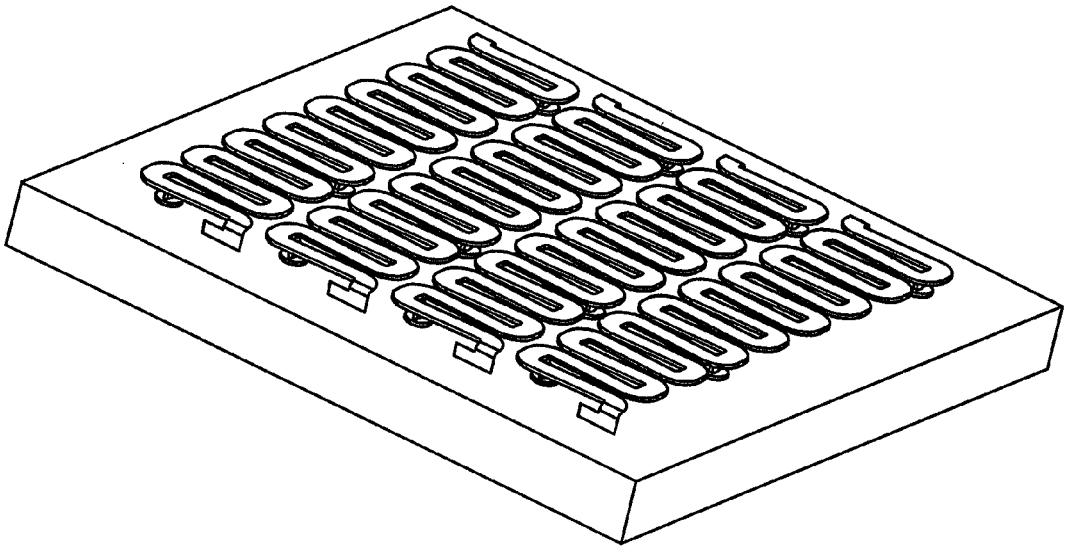
FIGS. 12A and 12B show two different perspective views of an exemplary embodiment of a heating assembly with a plurality of heating elements.
Figure 12B:
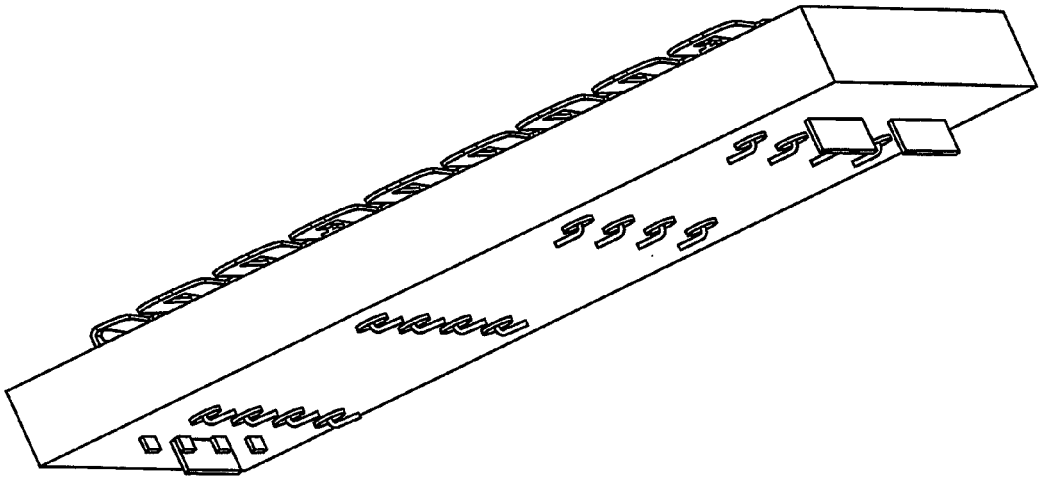

Heating elements disclosed herein can be incorporated into a furnace, such as a furnace for processing semiconductors. In such an application, multiple heating elements are positioned in an array or zone and are controlled for heating by a temperature control circuit. FIGS. 12A and 12B show two different perspective views of an exemplary embodiment of a heating assembly with a plurality of heating elements arranged in an array or zone.

Figure 13A:
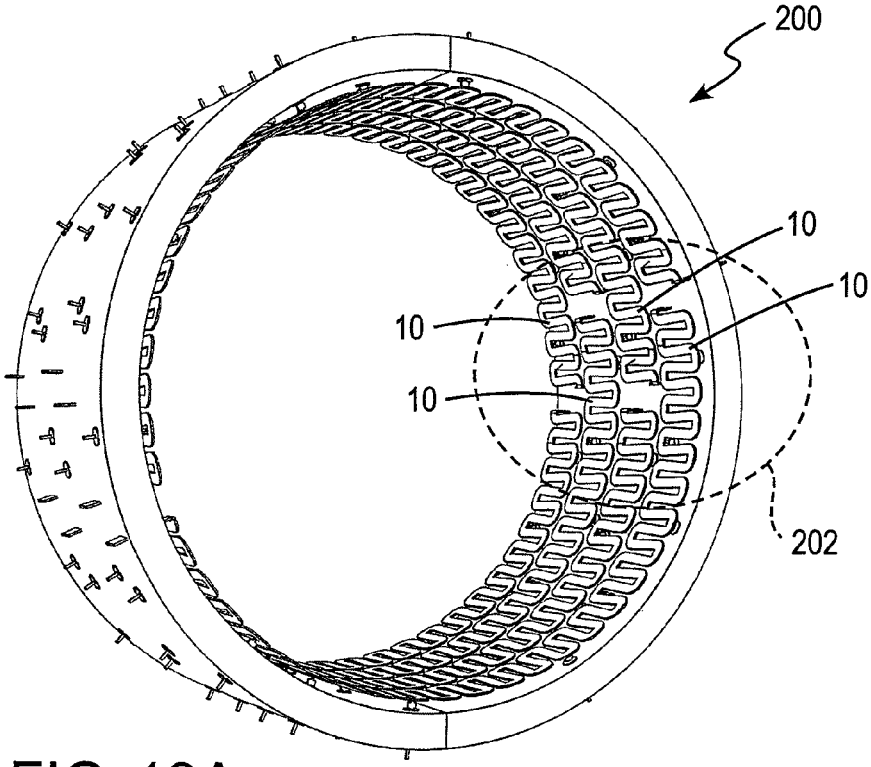
FIGS. 13A-E show examples heating element installations.
Figure 13B:
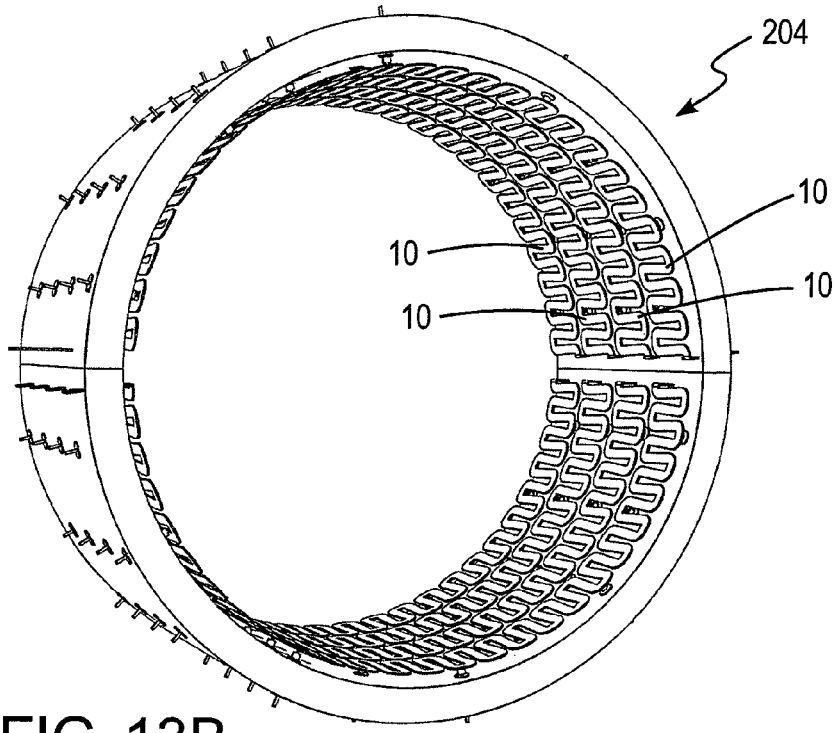
Figure 13C:
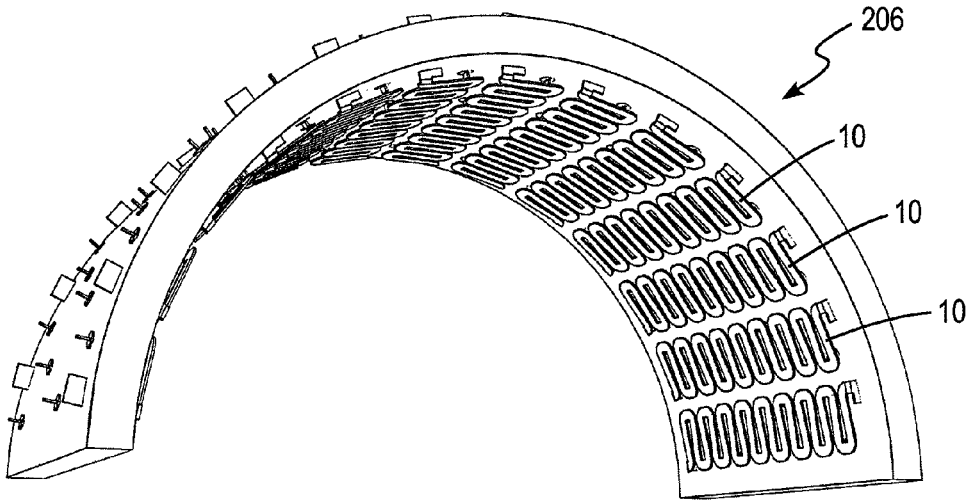
Figure 13D:
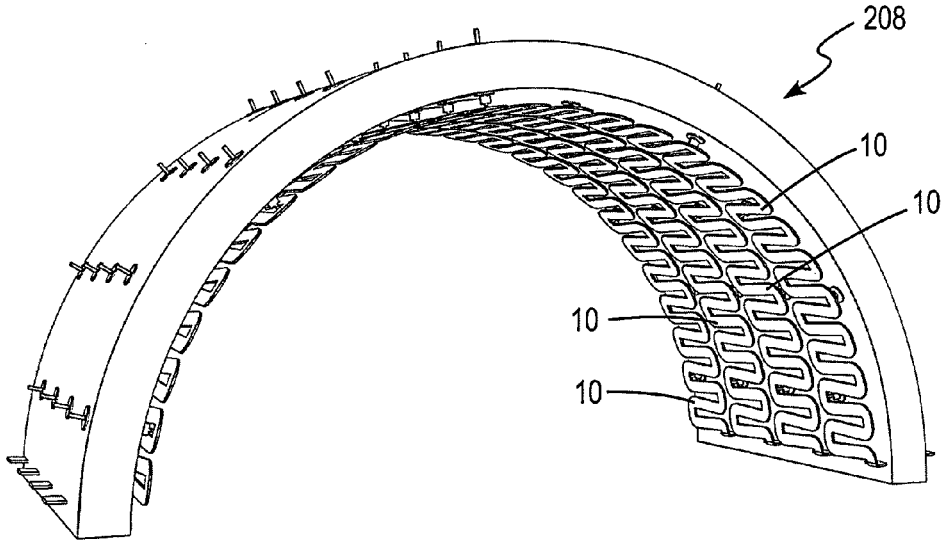
Figure 13E:
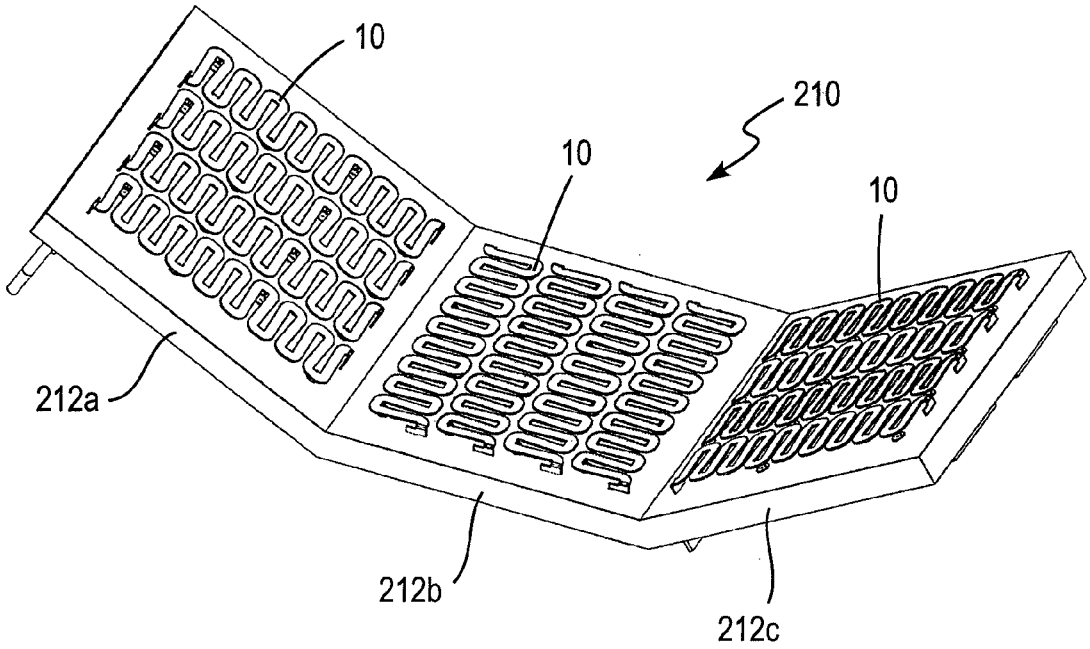

FIGS. 13A-E show examples heating element installations. FIG. 13A shows an exemplary cylindrical installation 200 with staggered heating elements 10 arranged in a circumferential direction, i.e., the axis of the heating element is not parallel to the axis of the cylinder. The staggered heating elements 10 are more clearly seen where the ends of the heating elements are visible, such as at location 202. Staggering contributes to minimizing non-uniformity caused by the void in emitter surface at the terminal end of the heating element by distributing this terminal end position within the assembly across the heating surface. The size of the stagger can be smaller or greater, depending on the application and the desired result. Further, a single heating element could be used to go around the circumference one or more times as opposed to using two or more semicircular segments. FIG. 13B shows another exemplary cylindrical installation 204 with non-staggered hearing elements 10 arranged in a circumferential direction, i.e., the axis of the heating element is not parallel to the axis of the cylinder. FIG. 13C shows an exemplary semi-cylindrical installation 206 with heating elements 10 arranged axially, i.e., the axis of the heating element is parallel to the axis of the cylinder. FIG. 13D shows an exemplary semi-cylindrical installation 208 with heating elements 10 arranged in a circumferential direction, i.e., the axis of the heating element is not parallel to the axis of the cylinder. FIG. 13E shows an exemplary planar-angled installation 210 with heating elements 10 on adjoining planar sections 212*a*, 212*b*, 212*c* being oriented in different directions. For example, the axes of the heating elements 10 in a first planar section 212*a* can be non-parallel, alternatively perpendicular, to the axes of the heating elements 10 in a second planar section 212*b*. The planar-angled installation 210 one can, for example, be used to approximate cylinder and semi-cylinders installations. These installations are merely illustrative and any installation arrangement can be used that obtains the desired heating and temperature profile.

The radii of the radiused segments are sized to maximize temperature uniformity and minimize stress. The inside radii have a particular low stress when compared to the conventional designs consisting primarily of curved sections. Further, the uniformity of surface temperatures is much improved relative to conventional designs consisting of square patterns with little or no radii at the corners.

The heating elements disclosed herein have a high surface loading factor, also known as a fill factor. Here, the pseudo-square and pseudo-sinusoidal heating elements have more emitter surface area than conventional designs consisting primarily of curved sections. This is, at least in part, because the angular sum of a single cycle is greater than 360 degrees. This puts the first straight segments in non-parallel relationship with a resulting longer length than parallel segments, and therefore, more emitting surface. Further, the distance $D_2$ is minimized while the distance $D_1$ is varied to accommodate the length ($L_2$) of the first straight segment 22. This contributes to a high fill factor while increasing temperature uniformity and lowering stress in the lobes 38. An example of a typical surface loading of total active area is approximately 145% of the emitter loading.

The heating elements disclosed herein contribute to controlling thermal expansion effects. Materials forming the heating element expand upon heating proportional to the coefficient of thermal expansion of the material. This expansion can cause the heating element to flex and bend, resulting in the emitter surface having a variable position relative to a piece to be heated (and, therefore, making the temperature profile more non-uniform). In extreme situations, the flexing and bending can result in short circuiting. The heating elements disclosed herein control and minimize the effects the thermal expansion. For example, the non-parallel orientation of the first straight segments direct a portion of the thermal expansion in the lateral direction into the longitudinal direction, and therefore maintains the orientation relative to the piece to be heated and a more uniform temperature profile. In another example, the edges of the pattern can be curved or bent along the lateral axis in order to direct the thermal expansion toward the insulating substrate to permit placement of the heating element closer to adjacent objects, such as additional circuits, with reduced instance of short circuiting.

The use of mounting means with a stand-off distance can also contribute to improved performance. Alternating support locations along the length of the circuitous path allows thermal expansion of the heating element to be directed into a twisting or torsional movement of the heating element between the supports and not just in planar movement.

The heating elements disclosed herein are free-radiating. That is, the mounting members provide a stand-off distance for the heating element relative to the insulating substrate. The architecture allows for heat to emit from all sides evenly and without the use of extra electrical energy to compensate for, for example, heating a substrate in surface contact to the heating element. Thus, the free-radiating heating element lowers the operating temperature of the emitter. Further, such a heating element will have a longer life at the same substrate power density as conventional heating elements or, alternatively, can operate at higher power densities over comparably life times.

The disclosed embodiments result in a high performance heating element combining low mass and high surface area. The disclosed patterns enable a high degree of automation in the fabrication and assembly process and precise geometries yielding uniform heating and consistent performance.

Several variations of the heating element can be made. For example, the heating element can have different thicknesses, varying, for example, from about 0.5 mm to about 10 mm. Also for example, the heating element can have different widths, based on the width of the straight segments, varying, for example, from about 5 mm or longer. These variations in width and thickness can be suitably incorporated as long as the basic features of the geometry are maintained, i.e., the non-parallel first straight segments and a substantially straight overall pattern.

While the drawing figures disclose embodiments that are substantially planar in configuration, it will be appreciated by those skilled in that art that the disclosed geometries can be applied to assemblies that have curved surfaces such as cylinders or semi-cylinders. The variation that incorporates the separate mounting means specifically lends itself to those configurations by allowing the emitter to be appropriately formed to conform to the curved surface, and then fixed in place by the separate mounting means. Curved surface configurations may also be constructed by arranging the emitter segments so that they run along the axial length of the curved surface, or by approximating the desired curved geometry with a series of planar panels.

Although described in connection with preferred embodiments thereof, it will be appreciated by those skilled in the art that additions, deletions, modifications, and substitutions not specifically described may be made without department from the spirit and scope of the invention as defined in the appended claims.

What is claimed is:

1. A heating assembly, comprising:

a heating element including a continuous planar strip, wherein a path of the continuous strip from a first end to a second end is circuitous and includes a plurality of repeating cycles, each repeating cycle including a plurality of first straight segments, a plurality of second straight segments and a plurality of radiused segments, wherein a length of one of the plurality of first straight segments is greater than a length of one of the plurality of second straight segments, and wherein an angular sum of a single one of the plurality of repeating cycles of the circuitous path is greater than 360 degrees.

2. The heating assembly of claim 1, wherein the plurality of first straight segments include a first group that is non-parallel to a second group.

3. The heating assembly of claim 1, wherein the plurality of first straight segments are oriented generally laterally to an axis oriented from a first end of the heating element to a second end of the heating element and wherein the plurality of second straight segments are oriented generally longitudinally to the axis.

4. The heating assembly of claim 1, wherein the plurality of second straight segments are oriented generally longitudinally to an axis orienting from a first end of the heating element to a second end of the heating element and any two consecutive second straight segments of the plurality of second straight segments are parallel.

5. The heating assembly of claim 1, wherein two of the plurality of radiused segments and one of the plurality of second straight segments form a lobe, wherein the single cycle has two lobes and wherein the one second straight segment separates the two radiused segments.

6. The heating assembly of claim 5, wherein an angular sum of one of the two lobes lobe of the single cycle is greater than 180 degrees.

7. The heating assembly of claim 6, wherein an angular sum of the one of the two lobes of the single cycle is greater than 180 degrees to about 200 degrees.

8. The heating assembly of claim 1, wherein an angle of one of the plurality of radiused segments is between 90 degrees and 135 degrees.

9. The heating assembly of claim 1, wherein a ratio of a sum of the lengths of two of the plurality of first straight segments and two of the plurality of second straight segments to a sum of the lengths of two of the plurality of radiused segments is greater than 2.0.

10. The heating assembly of claim 9, wherein the ratio is greater than 2.2.

11. The heating assembly of claim 1, further comprising a plurality of mounting members, wherein the plurality of mounting members extend from a periphery of the continuous strip at a plurality of locations along the circuitous path.

12. The heating assembly of claim 11, wherein the circuitous path is sinuous-like and the plurality of locations are on an inner edge of the sinuous-like path proximate a maximum lateral position of the sinuous-like path.

13. The heating assembly of claim 11, wherein the circuitous path is a sinuous path and the plurality of locations are on an outer edge of the sinuous path proximate a maximum lateral position of the sinuous-like path.

14. The heating assembly of claim 11, wherein successive locations of the plurality of mounting members are on alternating peripheral edges of the continuous strip.

15. The heating assembly of claim 11, wherein an emitting surface of the continuous planar strip extends in and is contained in a first plane, and wherein the plurality of mounting members are integrally formed with the continuous strip and extend from the periphery of the continuous strip in substantially a second plane, the second plane different from the first plane.

16. The heating assembly of claim 15, wherein the plurality of mounting members include a base end and a distal end and include an integrated spacer at the base end.

17. The heating assembly of claim 16, further comprising a substrate, wherein a length that the integrated spacer extends from the base end defines a stand-off distance for the continuous planar strip when the continuous planar strip is mounted to the substrate.

18. The heating assembly of claim 11, wherein an emitting surface of the continuous planar strip extends in and is contained in a first plane, and wherein the plurality of mounting members include an opening integrally formed on the continuous strip and an extension assembly including a pin and a spacer, wherein the pin is operably positioned in the opening to extend in substantially a second plane, the second plane different from the first plane.

19. The heating assembly of claim 3, wherein the circuitous path is pseudo-sinusoidal relative to the axis.

20. The heating assembly of claim 3, wherein the circuitous path is pseudo-square relative to the axis.

21. The heating assembly of claim 1, wherein the heating element is formed from a resistance alloy.

22. The heating assembly of claim 1, comprising a power terminal at a first end or a second end of the heating element.

23. A heating assembly comprising:

an insulating substrate; and a heating element, including a continuous planar strip, wherein a path of the continuous strip from a first end to a second end is circuitous and includes a plurality of repeating cycles, each repeating cycle including a plurality of first straight segments, a plurality of second straight segments and a plurality of radiused segments, wherein a length of one of the plurality of first straight segments is greater than a length of one of the plurality of second straight segments, and wherein an angular sum of a single one of the plurality of repeating cycles of the circuitous path is greater than 360 degrees, wherein the heating element is mounted in spaced relation to the insulating substrate by the plurality of mounting members.

24. The heating assembly of claim 23, wherein the insulating substrate is formed from an insulating material.

25. The heating assembly of claim 23, wherein the plurality of first straight segments include a first group that is non-parallel to a second group.

26. A method of manufacturing a heating assembly, the method comprising:

forming a heating element body from a resistance alloy, the heating element body including: a continuous planar strip with an emitting surface, and a plurality of mounting members;

bending the plurality of mounting members out of plane relative to the continuous strip; and inserting the plurality of mounting members into a substrate until an integrated spacer on the mounting members contacts the substrate, wherein a path of the continuous strip from a first end to a second end is circuitous and includes a plurality of repeating cycles, each repeating cycle including a plurality of non-parallel first straight segments, a plurality of second straight segments and a plurality of radiused segments, wherein a length of one of the plurality of first straight segment segments is greater than a length of one of the plurality of second straight segments segment, and wherein an angular sum of a single one of the plurality of repeating cycles of the circuitous path is greater than 360 degrees.

27. The method of claim 26, further comprising attaching a power source to the heating element.

28. A method of manufacturing a heating assembly, the method comprising:

forming a heating element body from a resistance alloy, the heating element body including a continuous planar strip with an emitting surface; and inserting a plurality of mounting members through an opening integrally formed on the continuous strip and into a substrate until a spacer associated with the mounting members contacts the substrate, wherein a path of the continuous strip from a first end to a second end is circuitous and includes a plurality of repeating cycles, each repeating cycle including a plurality of non-parallel first straight segments, a plurality of second straight segments and a plurality of radiused segments, wherein a length of one of the plurality of first straight segments is greater than a length of one of the plurality of second straight segments, and wherein an angular sum of a single one of the plurality of repeating cycles of the circuitous path is greater than 360 degrees.

29. The method of claim 28, further comprising attaching a power source to the heating element.

30. The heating element of claim 6, wherein an angular sum of the one of the two lobes of the single cycle is greater than 185 degrees to about 190 degrees.

31. The heating assembly of claim 21, wherein the heating element is formed from an iron chromium aluminum alloy.

32. The heating assembly of claim 24, wherein the insulating substrate is formed from a ceramic fiber composite with an alumina facing layer and a blended ceramic fiber backing layer.

33. The heating assembly of claim 3, further comprising a plurality of mounting members, wherein the plurality of mounting members extend from a periphery of the continuous strip at a plurality of locations along the circuitous path, wherein the plurality of locations are on an inner edge of the circuitous path proximate a maximum lateral position of the circuitous path, and wherein the maximum lateral position is at a maximum position of positive or negative portions of the circuitous path relative to the axis.

* * * * *